United States Patent [19]

Pliefke

[11] Patent Number: 4,840,713

[45] Date of Patent: Jun. 20, 1989

[54] PROCESS FOR THE ELECTROCHEMICAL ROUGHENING OF ALUMINUM FOR USE IN PRINTING PLATE SUPPORTS

[75] Inventor: Engelbert Pliefke, Wiesbaden, Fed. Rep. of Germany

[73] Assignee: Hoechst Aktiengesellschaft, Frankfurt am Main, Fed. Rep. of Germany

[21] Appl. No.: 198,307

[22] Filed: May 25, 1988

[30] Foreign Application Priority Data

May 26, 1987 [DE] Fed. Rep. of Germany ..... 3717654

[51] Int. Cl.[4] ..... C25F 3/04

[52] U.S. Cl. ..... 204/129.75

[58] Field of Search ..... 204/129.4, 129.75

[56] References Cited

U.S. PATENT DOCUMENTS

| | | | |
|---|---|---|---|
| 1,376,366 | 4/1921 | Wertheimer | 204/129.75 |
| 3,193,485 | 7/1965 | Vincent | 204/141 |
| 3,284,326 | 11/1966 | Martin | 204/141 |
| 3,632,486 | 1/1972 | Hermann et al. | 204/33 |
| 3,766,043 | 10/1973 | Hermann et al. | 204/207 |
| 3,887,447 | 6/1975 | Sheasby et al. | 204/129.4 |
| 3,963,594 | 6/1976 | Brasko | 204/129.95 |
| 3,980,539 | 9/1976 | Lloyd et al. | 204/129.75 |
| 4,052,275 | 10/1977 | Gumbinner et al. | 204/129.95 |
| 4,072,589 | 2/1978 | Golda et al. | 204/129.4 |
| 4,087,341 | 5/1978 | Takahashi et al. | 204/129.43 |
| 4,172,772 | 10/1979 | Ould et al. | 204/129.85 |
| 4,201,836 | 5/1980 | Huang | 428/457 |
| 4,242,417 | 12/1980 | Huang | 428/457 |
| 4,272,342 | 6/1981 | Oda et al. | 204/129.4 |
| 4,294,672 | 10/1981 | Ohba et al. | 204/129.4 |
| 4,301,229 | 11/1981 | Sakaki et al. | 430/158 |
| 4,324,841 | 4/1982 | Huang | 428/457 |
| 4,395,305 | 7/1983 | Whitman | 156/665 |
| 4,427,506 | 1/1984 | Nguyen et al. | 204/129.4 |

FOREIGN PATENT DOCUMENTS

| | | |
|---|---|---|
| 0036672 | 9/1981 | European Pat. Off. . |
| 0132787 | 2/1985 | European Pat. Off. . |
| 120061 | 4/1901 | Fed. Rep. of Germany . |
| 25142/74 | 3/1974 | Japan . |
| 006571/76 | 2/1976 | Japan . |
| 141444/77 | 8/1977 | Japan . |
| 39169/70 | 11/1978 | Japan . |
| 76100/80 | 2/1980 | Japan . |
| 17580/80 | 2/1980 | Japan . |
| 879768 | 10/1961 | United Kingdom . |
| 1392191 | 4/1975 | United Kingdom . |
| 1400918 | 7/1975 | United Kingdom . |
| 2047274 | 11/1980 | United Kingdom . |

OTHER PUBLICATIONS

Din 4768 B1. 1, Oct. 1970, pp. 1–4.

Dowell, "The Alternating Current Etching of Aluminum Lithographic Sheet," Transactions of the Institute of Metal Finishing, 1979, vol. 57, pp. 138–144.

*Primary Examiner*—T. M. Tufariello

*Attorney, Agent, or Firm*—Foley & Lardner, Schwartz, Jeffery, Schwaab, Mack, Blumenthal & Evans

[57] ABSTRACT

A process is disclosed for the electrochemical roughening of aluminum for use in printing plate supports, which is carried out by means of an electrolyte containing sulfate ions and aluminum chloride; preference is given to sulfuric acid and aluminum chloride. Printing plate supports roughened by the process according to the present invention show a particularly uniform, pit-free and overall roughening structure.

11 Claims, No Drawings

PROCESS FOR THE ELECTROCHEMICAL ROUGHENING OF ALUMINUM FOR USE IN PRINTING PLATE SUPPORTS

BACKGROUND OF THE INVENTION

The present invention relates to a process for the electrochemical roughening of aluminum for use in printing plate supports, the process being performed by means of an altrnating current, preferably in an electrolyte containing sulfuric acid, chloride ions and aluminum ions.

Printing plates (this term referring to offset-printing plates, within the scope of the present invention) usually comprise a support and at least one radiation-sensitive (photosensitive) reproduction layer arranged thereon, the layer being applied to the support either by the user (in the case of plates which are not pre-coated) or by the industrial manufacturer (in the case of precoated plates).

As a layer support material, aluminum or alloys thereof have gained general acceptance in the field of printing plates. In principle, it is possible to use these supports without modifying pretreatment, but they are generally modified in or on their surfaces, for example, by a mechanical, chemical and/or electrochemical roughening process (sometimes also called graining or etching in the literature), a chemical or electrochemical oxidation process and/or a treatment with hydrophilizing agents. In modern continuously working high-speed equipment employed by the manufacturers of printing plate supports and/or pre-coated printing plates, a combination of the aforementioned modifying methods is frequently used, particularly a combination of electrochemical roughening and anodic oxidation, optionally followed by a hydrophilizing step.

Roughening is, for example, carried out in aqueous acids, such as aqueous solutions of HCl or $HNO_3$ or in aqueous salt solutions, such as aqueous solutions of NaCl or $Al(NO_3)_3$, using an alternating current. The peak-to-valley heights (specified, for example, as mean peak-to-valley heights $R_z$) of the roughened surface, which can thus be obtained, are in the range from about 1 to 15 μm, particularly in the range from about 2 to 8 μm. The peak-to-valley height is determined according to DIN 4768 (in the October 1970 version). The peak-to-valley height $R_z$ is then the arithmetic mean calculated from the individual peak-to-valley height values of five mutually adjacent individual measurement lengths.

Roughening is, inter alia, carried out in order to improve the adhesion of the reproduction layer to the support and to improve the water/ink balance of the printing form which results from the printing plate upon irradiating (exposure) and developing. By irradiating and developing (or decoating, in the case of electrophotographically-working reproduction layers), the ink-receptive image areas and the water-retaining non-image areas (generally the bared support surface) in the subsequent printing operation, are produced on the printing plate, and thus the actual printing form is obtained. The final topography of the aluminum surface to be roughened is influenced by various parameters.

The paper "The Alternating Current Etching of Aluminum Lithographic Sheet", by A. J. Dowell, published in *Transactions of the Institute of Metal Finishing*, 1979, Vol. 57, pages 138 to 144, presents basic comments on the roughening of aluminum in aqueous solutions of hydrochloric acid, based on variations of the following process parameters and an investigation of the corresponding effects. The electrolyte composition is changed during repeated use of the electrolyte, for example, in view of the $H^+(H_3O^+)$ ion concentration (measurable by means of the pH) and in view of the $Al^{3+}$ ion concentration, with influences on the surface topography being observed. Temperature variations between 16° C. and 90° C. do not show an influence causing changes until temperatures are about 50° C. or higher, the influence becoming apparent, for example, as a significant decrease in layer formation on the surface. Variations in roughening time between 2 and 25 minutes lead to an increasing metal dissolution with increasing duration of action. Variations in current density between 2 and 8 $A/dm^2$ result in higher roughness values with rising current density. If the acid concentration is in a range from 0.17% to 3.3% of HCl, only negligible changes in pit structure occur between 0.5% and 2% of HCl, whereas below 0.5% of HCl, the surface is only locally attacked, and at high values, an irregular dissolution of aluminum takes place. If a direct current is used instead of an alternating current it appears that, obviously, both types of half-waves are necessary to achieve uniform roughening. It is already pointed out in the above-mentioned paper that the addition of sulfate ions increasingly produces undesired, coarse, non-homogenous roughening structures which are unsuitable for lithographic purposes.

The use of hydrochloric acid in the roughening of aluminum substrates is thus to be considered as being basically known in the art. A uniform graining can be obtained, which is appropriate for lithographic plates and is within a useful roughness range. In pure hydrochloric acid electrolytes, adjustment of an even and uniform surface topography is difficult and it is necessary to keep the operating conditions within very close limits.

The influence of the electrolyte composition on the quality of roughening is, for example, also described in the following publications:

German Offenlegungsschrift No. 22 50 275 (=British Patent Specification No. 1,400,918) specifies aqueous solutions containing from 1.0% to 1.5% by weight of $HNO_3$ or from 0.4% to 0.6% by weight of HCl and optionally from 0.4% to 0.6% by weight of $H_3PO_4$, for use as electrolytes in the roughening of aluminum for printing plate supports, by means of an alternating current, and German Offenlegungsschrift No. 28 10 308 (=U.S. Pat. No. 4,072,589) mentions aqueous solutions containing from 0.2% to 1.0% by weight of HCl and from 0.8% to 6.0% by weight of $HNO_3$ as electrolytes in the roughening of aluminum with an alternating current.

Additives used in the HCl electrolyte serve the purpose of preventing an adverse local attack in the form of deep pits. The following additives to hydrochloric acid electrolytes are, for example, described:

- in German Offenlegungsschrift No. 28 16 307 (=U.S. Pat. No. 4,172,772): monocarboxylic acids, such as acetic acid,
- in U.S. Pat. No. 3,963,594: gluconic acid,
- in European Patent Application No. 0 036 672: citric acid and/or malonic acid, and
- in U.S. Pat. No. 4,052,275: tartaric acid.

All these organic electrolyte components have the disadvantage of being electrochemically unstable and of decomposing in the case of a high current load (voltage).

Inhibiting additives, for example, phosphoric acid and chromic acid as described in U.S. Pat. No. 3,887,447 or boric acid as described in German Offenlegungsschrift No. 25 35 142 (=U.S. Pat. No. 3,980,539) have the disadvantage that there is often a local breakdown of the protective effect and individual, particularly pronounced pits can form in these places.

Japanese Patent Application Disclosure No. 17580/80 describes roughening by means of an alternating current in a composition comprising hydrochloric acid and an alkali-metal halide to produce a lithographic support material.

German Offenlegungsschrift No. 16 21 115 (=U.S. Pat. Nos. 3,632,486 and 3,766,043) describes roughening by means of a direct current, for example, for decorative panellings, using dilute hydrofluoric acid, the aluminum being switched such that it forms the cathode.

German Patent No. 120 061 describes a treatment for generating a hydrophilic layer by the application of electric current, which treatment can also be performed in hydrofluoric acid.

German Offenlegungsschrift No. 29 34 597 (=U.S. Pat. Nos. 4,201,836, 4,242,417 and 4,324,841) describes an optionally electrochemical roughening of aluminum, using a saturated aluminum salt solution which may additionally be admixed with up to 10% of a mineral acid. The examples given are based on aluminum chloride as the salt and hydrochloric is optionally added.

A saturated aluminum chloride solution of this kind (>500 g/l of $AlCl_3 \times 6H_2O$), in particular in the acidic region, represents an acute corrosion hazard to the materials used. Specifically, the surface quality obtainable with sulfuric acid as the mineral acid added, which is, however, not described in the examples, would be very pitted and thus unsuitable for lithographic applications, as shown by Comparative Examples C24 to C33.

Japanese Patent Publication No. 006571/76 describes roughening of an aluminum sheet for lithographic printing plates, using an alternating current in electrolytes containing from 1% to 4% of HCl and from 0.1% to 1% of $H_2SO_4$. As shown by Comparative Examples C34 to C53, the surface profiles obtainable in this range of concentration of the electrolyte show an irregular roughening and are not in accordance with the state of the art.

In British Patent No. 1,392,191, the influence of sulfate ions present in concentrations of more than 10 to 15 ppm in hydrochloric acid electrolytes used in the preparation of a lithographic support material, is described as being detrimental and, to overcome this difficulty, an addition of phosphoric acid is employed.

According to European Patent Application No. 0 132 787 aluminum for use as a support material for printing plates is roughened in 1,000 to 40,000 ppm of nitric acid containing from 50 to 4,000 ppm (up to 0.4%) of sulfate ions; also in this case, the detrimental influence of higher concentrations is mentioned. It is stated that over 5,000 ppm roughening is even prevented.

In U.S. Pat. No. 1,376,366, an electrochemical treatment of metals, in particular steel, is described, in which direct current is used in a solution comprising ammonium chloride, sulfuric acid and nitric acid. In this process, a shaping treatment of a workpiece is attempted. A roughening treatment for lithographic surfaces, on the other hand, is intended to produce a very fine (1 to 10 μm), coat-free structuring of the surface, by which good anchoring of the copying layer and retaining of the dampening solution during the printing process is to be ensured. Formation of a coat during roughening can be suppressed by the application of an alternating current.

U.S. Pat. No. 3,284,326 describes roughening of an aluminum foil for use in the manufacture of capacitors. In the process direct current is employed to achieve a high capacitance. The electrolyte used comprises a solution of chloride and phosphate, the type of the cation—with the exception of the disadvantageous aluminum—being insignificant in view of the roughening of the capacitor foil. Up to 10 mol-% of the cation can also be replaced by $H^+$; it is, however, pointed out in the specification that it is not good to start the process with an acid-containing electrolyte.

According to the following publications, roughening of aluminum for use as a capacitor foil is carried out in systems containing aluminum chloride and sulfate: U.S. Pat. No. 4,427,506, U.S. Pat. No. 4,395,305, Japanese Patent Application Disclosure No. 76100/80, Japanese Patent Publication No. 39169/78, Japanese Patent Application Disclosure No. 141444/77 and Japanese Patent Publication No. 25142/74.

In contrast to the sole object of producing a marked surface enlargement in foils for use in capacitors, the basically different roughening employed for printing plate supports serves to improve the anchoring of the copying layer and the water/ink balance and must therefore be very homogeneous and pit-free within a narrow range of peak-to-valley heights.

In U.S. Pat. No. 4,427,506 it is pointed out that in connection with the manufacture of capacitor foils a content of sulfate ions >500 ppm is detrimental.

Another known possibility of improving the uniformity of electrochemical roughening comprises a modification of the type of electric current employed, including, for example, using an alternating current in which the anodic voltage and the anodic coulombic input are higher than the cathodic voltage and the cathodic coulombic input, according to German Offenlegungsschrift No. 26 50 762 (=U.S. Pat. No. 4,087,341, the anodic half-cycle period of the alternating current being generally adjusted to be less than the cathodic half-cycle period; this method is, for example, also referred to in German Offenlegungsschrift No. 29 12 060 (=U.S. Pat. No. 4,301,229), German Offenlegungsschrift No. 30 12 135 (=published UK Patent Application No. 2,047,274) or German Offenlegungsschrift No.30 30 815 (=U.S. Pat. No. 4,272,342), using an alternating current in which the anodic voltage is markedly increased compared with the cathodic voltage, according to German Offenlegungsschrift No. 14 46 026 (=U.S. Pat. No. 3,193,485), interrupting the current flow for 10 to 120 seconds and re-applying current for 30 to 300 seconds, using an alternating current and, as the electrolyte, an aqueous solution of 0.75 to 2.0 N HCl, with the addition of NaCl or $MgCl_2$, according to British Patent No. 879,768. A similar process comprising an interruption of current flow in the anodic or cathodic phase is also disclosed in German Offenlegungsschrift No. 30 20 420 (=U.S. Pat. No. 4,294,672).

The aforementioned methods may lead to relatively uniformly roughened aluminum surfaces, but they sometimes require a comparatively great equipment expenditure and, in addition, are applicable only within closely limited parameters.

SUMMARY OF THE INVENTION

It is therefore an object of the present invention to provide a process for the electrochemical roughening of aluminum for use in printing plate supports by means of an alternating current, which process results in a uniform, pit-free and overall roughening structure and in which great equipment expenditure, specific selection of material for reasons of corrosion prevention, and/or particularly closely limited parameters can be avoided.

In accordance with these and other objects of the invention, there is provided a process for electrochemical roughening of supports of aluminum and aluminum alloys for use in printing plates, comprising the steps of immersing the support in an acidic, non-saturated solution of aluminum chloride comprising sulfate ions and applying an alternating current to electrochemically roughen the support.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

The process for the electrochemical roughening of aluminum or alloys thereof for use in printing plate supports is performed by means of an alternating current in an electrolyte containing sulfate ions and chloride ions, the acidic, sulfate-containing electrolyte comprising chloride ions in the form of aluminum chloride.

As demonstrated by Comparative Examples C58-C59 and Example 57, the presence of aluminum ions which render the surface uniform is, in any case, advantageous to the process of the invention for the preparation of printing plate supports. Comparative Example C60 and C61 show that the application of direct current also leads to heavily pitted surfaces which are entirely unsuitable for lithographic purposes. In addition, an undesirable white coat occurs and the sheets do not exhibit an overall roughening.

In the production of lithographic printing plates, electrochemical roughening is, unexpectedly, possible with sulfate ions in a relatively high concentration of 5 to 100 g/l, by the addition of chlorides in the form of aluminum chloride. Lower concentrations of, for example, sulfuric acid, produce a non-uniform surface structure.

In a preferred embodiment, a $H_2SO_4$ electrolyte is used, the concentration of sulfate ions being between about 5 and 100 g/l, particularly preferably between about 20 and 50 g/l, and the concentration of the chloride ions between about 1 and 100 g/l, particularly preferably between about 10 and 70 g/l.

Chloride ions are used in a preferred embodiment, in the form of $AlCl_3 \times 6H_2O$ in a concentration between about 20 and 250 g/l, particularly preferably between about 50 and 200 g/l.

In a preferred embodiment, the pH of the electrolyte is less than 2.

Higher concentrations of chloride ions intensify the local attack giving rise to objectionable pits. Within the scope of the present invention it is also intended to use combinations of various compounds containing chloride ions.

In a preferred treatment step following electrochemical roughening the material is additionally chemically etched by means of an etching solution to clean the surface from any coat which may be present. Chemical etching is particularly preferably carried out using a solution containing sulfuric acid,or using sodium hydroxide solution, but, in principle, all metal-attacking systems can be used to remove the surface coating.

According to the process of the present invention an extremely even support surface which can be varied within a wide range of peak-to-valley heights ($R_z=2$ to 5 μm) and has excellent lithographic properties is obtained.

The process of the invention is carried out either discontinuously or preferably continuously, using webs of aluminum or aluminum alloys. In continuous processes, the process parameters during roughening are generally within the following ranges: temperature of the electrolyte between about 20° and 60° C., current density between about 3 and 230 A/dm$^2$, dwell time of a material spot to be roughened in the electrolyte between about 10 and 300 seconds, and rate of flow of the electrolyte on the surface of the material to be roughened between about 5 and 100 cm/second. In a preferred embodiment, the current density is greater than about 40 A/dm$^2$. Due to the continuous procedure and the simultaneous liberation of Al ions and the consumption of $H^+$, the electrolyte composition has to be continuously readjusted by adding the appropriate dilute acids.

In discontinuous processes, the required current densities are rather in the lower region and dwell times in the upper region of the ranges indicated in each case; a flow of the electrolyte can even be dispensed with in these processes.

In addition to the current types mentioned in the description of the prior art, it is also possible to use superimposed alternating current and low-frequency currents.

The following materials which are in the form of a sheet, a foil or a web may, for example, be used for roughening in the process of the invention:

"Pure aluminum" (DIN Material No. 3.0255), i.e., composed of more than 99.5% Al, and the following permissible admixtures (maximum total 0.5%) of 0.3% Si, 0.4% Fe, 0.03% Ti, 0.02% Cu, 0.07% Zn and 0.03% of other substances, or "Al-alloy 3003" (comparable to DIN Material No. 3.0515), i.e., composed of more than 98.5% Al, 0 to 0.3% Mg and 0.8% to 1.5% Mn, as alloying constituents, and 0.5% Si, 0.5% Fe, 0.2% Ti, 0.2% Zn, 0.1% Cu and 0.15% of other substances, as permissible admixtures.

The process of the present invention can, however, also be used with other aluminum alloys.

The electrochemical roughening process according to the present invention may be followed by an anodic oxidation of the aluminum in a further process step, in order to improve, for example, the abrasive and adhesive properties of the surface of the support material.

Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. The following are standard methods for the anodic oxidation of aluminum (see, in this regard, e.g., M. Schenk, Werkstoff, *Aluminium und seine*

*anodische Oxydation* [The Material Aluminum and its Anodic Oxidation], Francke Verlag, Bern, 1948, page 760; *Praktische Galvanotechnik* [*Practical Electroplating*], Eugen G. Leuze Verlag, Saulgau, 1970, pages 395 et seq., and pages 518/519; W. Huebner and C. T. Speiser, *Die Praxis der anodischen Oxidation des Aluminiums* [Practical Technology of the Anodic Oxidation of Aluminum], Aluminium Verlag, Duesseldorf, 1977, 3rd Edition, pages 137 et seq.):

The direct current sulfuric acid process, in which anodic oxidation is carried out in an aqueous electrolyte which conventionally contains approximately 230 g of $H_2SO_4$ per 1 liter of solution, for 10 to 60 minutes at 10° C. to 22° C., and at a current density of 0.5 to 2.5 A/dm$^2$. In this process, the sulfuric acid concentration in the aqueous electrolyte solution can also be reduced to 8% to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0° to 5° C., and at a current density of 2 to 3 A/dm$^2$, for 30 to 200 minutes, at a voltage which rises from approximately 25 to 30 V at the beginning of the treatment, to approximately 40 to 100 V toward the end of the treatment.

In addition to the processes for the anodic oxidation of printing plate support materials which have already been mentioned in the preceding paragraph, the following processes can, for example, also be used: the anodic oxidation of aluminum can be carried out, for example, in an aqueous, $H_2SO_4$ containing electrolyte, in which the content of $Al^{3+}$ ions is adjusted to values exceeding 12 g/l (according to German Offenlegungsschrift No. 28 11 39 6=U.S. Pat. No. 4,211,619), in an aqueous electrolyte containing $H_2SO_4$ and $H_3PO_4$ (according to German Offenlegungsschrift No. 27 07 810=U.S. Pat. No. 4,049,504), or in an aqueous electrolyte containing $H_2SO_4$, $H_3PO_4$ and $Al^{3+}$ ions (according to German Offenlegungsschrift No. 28 36 803=U.S. Pat. No. 4,229,226).

Direct current is preferably used for the anodic oxidation, but it is also possible to use alternating current or a combination of these types of current (for example, direct current with superimposed alternating current).

The layer weights of aluminum oxide range from about 1 to 10 g/m$^2$, which corresponds to layer thicknesses from about 0.3 to 3.0 μm. After the electrochemical roughening step and prior to an anodic oxidation step, an etching modification of the roughened surface may additionally be performed, as described, for example, in German Offenlegungsschrift No. 30 09 103. A modifying intermediate treatment of this kind can, inter alia, enable the formation of abrasion-resistant oxide layers and reduce the tendency to scumming in the subsequent printing operation.

The anodic oxidation step of the aluminum support material for printing plates is optionally followed by one or more post-treatment steps. Post-treatment is particularly understood to be a hydrophilizing chemical or electrochemical treatment of the aluminum oxide layer, for example, an immersion treatment of the material in an aqueous solution of polyvinyl phosphonic acid according to German Patent No. 16 21 478 (=British Patent No. 1,230,447), an immersion treatment in an aqueous solution of an alkali metal silicate according to German Auslegeschrift No. 14 71 707 (=U.S. Pat. No. 3,181,461), or an electrochemical treatment (anodization) in an aqueous solution of an alkali metal silicate according to German Offenlegungsschrift No. 25 32 769 (=U.S. Pat. No. 3,902,976). These post-treatment steps serve, in particular, to even further improve the hydrophilic properties of the aluminum oxide layer, which are already sufficient for many fields of application, while maintaining the other well-known properties of the layer.

Suitable photosensitive reproduction layers basically comprise any layers which, after exposure, optionally followed by development and/or fixing, yield a surface in image configuration, which can be used for printing and/or which represents a relief image of an original. The layers are applied to the support materials, either by the manufacturer of presensitized printing plates or so-called dry resists, or directly by the user.

The photosensitive reproduction layers include those which are described, for example, in "Light-Sensitive Systems", by Jaromir Kosar, published by John Wiley & Sons, New York, 1965: layers containing unsaturated compounds, which, upon exposure, are isomerized, rearranged, cyclized, or crosslinked, e.g. cinnamates (Kosar, Chapter 4); layers containing compounds, e.g., monomers or prepolymers, which can be photopolymerized, which, on being exposed, undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7).

Other suitable layers include the electrophotographic layers, i.e., layers which contain an inorganic or organic photoconductor. In addition to the photosensitive substances, these layers can, of course, also contain other constituents, such as, for example, resins, dyes, pigments, wetting agents, sensitizers, adhesion promoters, indicators, plasticizers or other conventional auxiliary agents. In particular, the following photosensitive compositions or compounds can be employed in the coating of the support materials:

positive-working o-quinone diazide compounds, preferably o-naphthoquinone diazide compounds, which are described, for example, in German Pat. Nos. 854 890, 865 109, 879 203, 894 959, 938 233, 11 09 521, 11 44 705, 11 18 606, 11 20 273 and 11 24 817;

negative-working condensation products from aromatic diazonium salts and compounds with active carbonyl groups, preferably condensation products formed from diphenylamine-diazonium salts and formaldehyde, which are described, for example, in German Pat. Nos. 596,731, 11 38 399, 11 38 400, 11 38 401, 11 42 871, and 11 54 123, U.S. Pat. Nos. 2,679,498 and 3,050,502 and British Patent No. 712,606;

negative-working co-condensation products of aromatic diazonium compounds, for example, according to German Offenlegungsschrift No. 20 24 244, which possess, in each case, at least one unit of the general types $A(\text{-}D)_n$ and B, connected by a divalent linking member derived from a carbonyl compound which is capable of participating in a condensation reaction. In this context, these symbols are defined as follows: A is the radical of a compound which contains at least two aromatic carbocyclic and/or heterocyclic nuclei, and which is capable, in an acid medium, of participating in a condensation reaction with an active carbonyl compound, at one or more positions. D is a diazonium salt group which is bonded to an aromatic carbon atom of A; n is an integer from 1 to 10, and B is the radical of a compound which contains no diazonium groups and which is capable, in an acid medium, of participating in a condensation reaction with an active carbonyl compound, at one or more positions on the molecule;

positive-working layers according to German Offenlegungsschrift No. 26 10 842 containing a compound which, on being irradiated, splits off an acid, a compound which possesses at least one C-O-C group, which can be split off by acid (e.g., an orthocarboxylic acid ester group, or a carboxamide-acetal group), and, if appropriate, a binder;

negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften Nos. 20 64 079 and 23 61 041. Suitable photo-initiators are, inter alia, benzoin, benzoin ethers, polynuclear quinones, acridine derivatives, phenazine derivatives, quinoxaline derivatives, quinazoline derivatives, or synergistic mixtures. A large number of soluble organic polymers can be employed as binders, for example, polyamides, polyesters, alkyd resins, polyvinyl alcohol, polyvinylpyrrolidone, polyethylene oxide, gelatin or cellulose ethers;

negative-working layers according to German Offenlegungsschrift No. 30 36 077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photosemiconducting layers to the support materials, such as described, for example, in German Pat. Nos. 11 17 391, 15 22 497, 15 72 312, 23 22 046 and 23 22 047, as a result of which highly photosensitive electrophotographic layers are produced.

The materials for printing plate supports, which have been roughened according to the process of the present invention, exhibit a very uniform topography, which positively influences the stability of print runs and the water/ink balance during printing with printing forms manufactured from these supports. Objectionable "pits" (pronounced depressions, in comparison to the surrounding roughening) occur less frequently and can even be completely suppressed. Using the processes of the present invention it is, in particular, possible to produce even, pit-free supports. Compared with Comparative Examples C 24 to C33 and C34 to C53, the other examples show the effect of the electrolyte system according to the present invention as a means of obtaining surfaces which are even and, nevertheless, uniform. These surface properties can be materialized without particularly great equipment expenditure.

EXAMPLES

An aluminum sheet (DIN Material No. 3.0255) is first etched in an aqueous solution containing 20 g/l of NaOH, for 60 seconds, at room temperature. Roughening is carried out in the electrolyte systems specified in each case, at 40° C.

The invention is, however, not limited to the illustrative examples.

The classification into quality grades (surface topography with respect to uniformity, absence of pits and overall roughness) is effected by visual estimation under a microscope, quality grade "1" (best grade) being assigned to a surface which is homogeneously roughened and free from pits. Quality grade "10" (worst grade) is assigned to a surface showing great pits of more than 30 μm in size and/or an extremely non-uniformly roughened or almost millfinished surface.

TABLE I

| Example No. | Sulfuric Acid Concentration g/l | $AlCl_3 \times 6H_2O$ Concentration g/l | Current Density A/dm² | Time sec | Quality Grades 1 = very good 10 = extremely bad |
|---|---|---|---|---|---|
| 1 | 40 | 60 | 40 | 15 | 2 |
| 2 | 40 | 60 | 40 | 20 | 2 |
| 3 | 40 | 60 | 40 | 25 | 2 |
| 4 | 40 | 60 | 40 | 30 | 1–2 |
| 5 | 40 | 60 | 60 | 10 | 2 |
| 6 | 40 | 60 | 60 | 13 | 2 |
| 7 | 40 | 100 | 40 | 15 | 1–2 |
| 8 | 40 | 100 | 40 | 20 | 1–2 |
| 9 | 40 | 100 | 60 | 10 | 1–2 |
| 10 | 40 | 100 | 60 | 13 | 2 |
| 11 | 40 | 150 | 40 | 15 | 1–2 |
| 12 | 40 | 150 | 40 | 20 | 1–2 |
| 13 | 40 | 150 | 60 | 10 | 1–2 |
| 14 | 50 | 100 | 60 | 17 | 2 |
| 15 | 50 | 100 | 60 | 20 | 2 |
| 16 | 60 | 100 | 100 | 6 | 2 |
| 17 | 60 | 100 | 100 | 8 | 2 |
| 18 | 50 | 200 | 60 | 10 | 2 |
| 19 | 60 | 200 | 60 | 10 | 2 |
| 20 | 60 | 200 | 60 | 17 | 2 |
| 21 | 20 | 150 | 100 | 8 | 2 |
| 22 | 25 | 150 | 100 | 8 | 1–2 |
| 23 | 30 | 150 | 100 | 8 | 1 |
| C24 | 50 | 500 | 40 | 15 | 6 |
| C25 | 50 | 500 | 40 | 30 | 7 |
| C26 | 50 | 500 | 60 | 17 | 5–6 |
| C27 | 50 | 500 | 60 | 20 | 6 |
| C28 | 50 | 500 | 100 | 6 | 5–6 |
| C29 | 50 | 500 | 100 | 10 | 6 |
| C30 | 100 | 500 | 40 | 15 | 5–6 |
| C31 | 100 | 500 | 40 | 20 | 6 |
| C32 | 100 | 500 | 80 | 10 | 6 |
| C33 | 100 | 500 | 80 | 15 | 6–7 |

TABLE II

| Example No. | Sulfuric Acid Concentration g/l | Hydrochloric Acid Concentration g/l | Current Density A/dm² | Time sec | Quality Grades 1 = very good 10 = extremely bad |
|---|---|---|---|---|---|
| C34 | 1 | 10 | 40 | 15 | 4–5 |
| C35 | 1 | 10 | 40 | 25 | 5 |
| C36 | 1 | 10 | 80 | 10 | 6 |
| C37 | 1 | 10 | 80 | 15 | 6–7 |
| C38 | 1 | 40 | 40 | 15 | 6 |
| C39 | 1 | 40 | 40 | 25 | 6–7 |
| C40 | 1 | 40 | 80 | 10 | 6 |
| C41 | 1 | 40 | 80 | 15 | 5–6 |
| C42 | 10 | 10 | 40 | 15 | 6 |
| C43 | 10 | 10 | 40 | 25 | 5–6 |
| C44 | 10 | 10 | 80 | 10 | 6 |
| C45 | 10 | 10 | 80 | 15 | 6 |
| C46 | 10 | 40 | 40 | 15 | 5–6 |
| C47 | 10 | 40 | 40 | 25 | 6 |
| C48 | 10 | 40 | 80 | 10 | 7 |
| C49 | 10 | 40 | 80 | 15 | 7–8 |
| C50 | 5 | 25 | 40 | 15 | 8 |
| C51 | 5 | 25 | 40 | 25 | 7 |
| C52 | 5 | 25 | 80 | 10 | 5–6 |

TABLE II-continued

| Example No. | Sulfuric Acid Concentration g/l | Hydrochloric Acid Concentration g/l | Current Density A/dm$^2$ | Time sec | Quality Grades 1 = very good 10 = extremely bad |
|---|---|---|---|---|---|
| C53 | 5 | 25 | 80 | 15 | 5-6 |

TABLE III

| Example No. | Sulfuric Acid Concentration g/l | $AlCl_3 \times 6H_2O$ Concentration g/l | Hydrochloric Acid Concentration g/l | Current Density A/dm$^2$ | Time sec | Quality Grades 1 = very good 10 = extremely bad |
|---|---|---|---|---|---|---|
| 54 | 40 | 100 | 15 | 100 | 10 | 2 |
| 55 | 40 | 100 | 15 | 100 | 12 | 2 |
| 56 | 40 | 100 | 20 | 100 | 12 | 2 |
| 57 | 40 | 60 | - | 40 | 30 | 1-2 |

TABLE IV

| Example No. | Sulfuric Acid Concentration g/l | NaCl-Concentration g/l | Hydrochloric Acid Concentration g/l | Current Density A/dm$^2$ | Time sec | Quality Grades 1 = very good 10 = extremely bad |
|---|---|---|---|---|---|---|
| C58 | 40 | 43.3 | — | 40 | 30 | 8 |
| C59 | 40 | 60 | — | 40 | 30 | 8 |
| C60 | 40 | 60 | — | 40* | 30 | 7 |
| C61 | 40 | 60 | — | 40* | 60 | 7 |

*Direct Current

What is claimed is:

1. A process for electrochemical roughening of supports of aluminum and aluminum alloys for use in printing plates, comprising the steps of:

immersing the support in an electrolytic, acidic, unsaturated solution of aluminum chloride comprising from 5 to 100 g/l sulfate ions and from 1 to 100 g/l chloride ions; and applying an alternating current to electrochemically roughen the support.

2. A process as claimed in claim 1, wherein the electrolyte comprises sulfuric acid.

3. A process as claimed in claim 1, wherein the concentration of sulfate ions ranges between 20 an 50 g/l.

4. A process as claimed in claim 1, wherein the concentration of the chloride ions is in the range of 10 to 70 g/l.

5. A process as claimed in claim 1, wherein the concentration of the aluminum chloride is from 20 to 250 g/l, relative to the electrolyte.

6. A process as claimed in claim 1, wherein the current density used is greater than 40 A/dm$^2$.

7. A process as claimed in claim 1, wherein roughening is carried out for a duration of from 3 to 30 seconds.

8. A process as claimed in claim 1, wherein further acids or salts are added to the electrolyte.

9. A process as claimed in claim 1, additionally comprising anodization.

10. A process as claimed in claim 1, wherein the pH of the electrolyte is less than 2.

11. A process as claimed in claim 9, additionally comprising a chemical treatment step between said electrochemical roughening step and said anodization.

* * * * *